US012571334B2

(12) United States Patent
Takano et al.

(10) Patent No.: US 12,571,334 B2
(45) Date of Patent: Mar. 10, 2026

(54) CLOSING STRUCTURE FOR TUBE MEMBER AND ENGINE PROVIDED THEREWITH

(71) Applicant: KAWASAKI MOTORS, LTD., Hyogo (JP)

(72) Inventors: Goki Takano, Akashi (JP); Kazuki Masui, Grand Rapids, MI (US); Derek Pauls, Grand Rapids, MI (US); Matt Schultz, Grand Rapids, MI (US)

(73) Assignee: KAWASAKI MOTORS, LTD., Hyogo (JP)

( * ) Notice: Subject to any disclaimer, the term of this patent is extended or adjusted under 35 U.S.C. 154(b) by 132 days.

(21) Appl. No.: 18/117,024

(22) Filed: Mar. 3, 2023

(65) Prior Publication Data

US 2024/0295182 A1 Sep. 5, 2024

(51) Int. Cl.
*F01M 11/04* (2006.01)
*F01M 11/12* (2006.01)

(52) U.S. Cl.
CPC ..... *F01M 11/04* (2013.01); *F01M 11/12* (2013.01); *F01M 2011/0491* (2013.01)

(58) Field of Classification Search
CPC . F01M 11/04; F01M 11/12; F01M 2011/0491
USPC ..... 123/196 R
See application file for complete search history.

(56) References Cited

U.S. PATENT DOCUMENTS 3,474,884 A * 10/1969 Braun ..... F16N 19/003 184/6.4
5,829,620 A 11/1998 Harris et al.
2012/0097482 A1* 4/2012 Miller ..... F01M 11/12 184/6.4
2019/0193556 A1* 6/2019 Yamamoto ..... B60K 15/035

* cited by examiner

*Primary Examiner* — Lindsay M Low
*Assistant Examiner* — Omar Morales
(74) *Attorney, Agent, or Firm* — Wenderoth, Lind & Ponack, L.L.P.

(57) ABSTRACT

A closing structure includes: a fluid reservoir for storing a fluid; a tube member having a mouth end surface at a tip in an axial direction of the tube member, the tube member having an inside communicating with the fluid reservoir; a gasket configured to be disposed on the mouth end surface of the tube member; an end cap configured to: (i) be attached to the tube member; and (ii) close the tube member at the mouth end surface of the tube member through the gasket; and a clamping piece fixed to the end cap, the clamping piece being configured to clamp the gasket between the clamping piece and the end cap.

18 Claims, 5 Drawing Sheets

CLOSING STRUCTURE FOR TUBE MEMBER AND ENGINE PROVIDED THEREWITH

BACKGROUND OF THE INVENTION

Technical Field

The present invention relates to a closing structure for a tube member and an engine provided therewith.

Related Art

U.S. Pat. No. 5,829,620 discloses an engine provided with an oil filler. The oil filler has a distal end communicating with an oil reservoir inside the engine, and has a mouth end portion for supplying engine oil to the proximal end. The mouth end portion is closed by an end cap. A gasket for closing the oil filler between the end cap and the mouth end portion is attached to the end cap. The gasket is fixed to the end cap with an adhesive, and the gasket is prevented from falling off from the end cap when the end cap is detached and attached.

SUMMARY

When the adhesive for fixing the gasket deteriorates over time, the gasket may fall off the end cap when the end cap is removed from the oil filler cap. In addition, it is desired to reduce the number of steps of attaching the gasket to the end cap using an adhesive. An object of the present disclosure is to provide a closing structure for a tube member capable of preventing a gasket from falling off an end cap.

One aspect of the present disclosure provides a closing structure for a tube member including: a fluid reservoir in which a fluid is to be stored; a tube member extending in a tubular shape, the tube member having a mouth end surface formed at a tip in an axial direction, the tube member having an inside communicating with the fluid reservoir; a gasket disposed on the mouth end surface; an end cap attached to the tube member, the end cap being configured to close the tube member at the mouth end surface through the gasket; and a clamping piece fixed to the end cap, the clamping piece being configured to clamp the gasket between the clamping piece and the end cap.

According to the present disclosure, since the gasket is clamped between the end cap and the clamping piece fixed to the end cap, the gasket is easily held between the end cap and the clamping piece when the end cap is detached from the tube member, and the gasket is easily prevented from falling off.

Another aspect of the present disclosure provides a closing structure for a tube member including: a fluid reservoir in which a fluid is to be stored; a tube member extending in a tubular shape, the tube member having a mouth end surface formed at a tip in an axial direction, the tube member having an inside communicating with the fluid reservoir; a gasket disposed on the mouth end surface; and an end cap attached to the tube member, the end cap being configured to close the tube member at the mouth end surface through the gasket. The end cap includes a clamping piece configured to clamp the gasket between the clamping piece and the end cap.

According to the present disclosure, since the gasket is clamped between the end cap and the clamping piece fixed to the end cap, the gasket is easily held between the end cap and the clamping piece when the end cap is detached from the tube member, and the gasket is easily prevented from falling off. In addition, since the clamping piece is integrally formed with the end cap, it is not necessary to form the clamping piece as a separate body, and the structure can be easily simplified.

A still another aspect of the present disclosure provides an engine having a closing structure for a tube member according to the above aspect.

BRIEF DESCRIPTION OF THE DRAWINGS

The foregoing and the other features of the present invention will become apparent from the following description and drawings of an illustrative embodiment of the invention in which.

DETAILED DESCRIPTION OF EMBODIMENTS

Hereinafter, an engine according to an embodiment of the present disclosure will be described with reference to the accompanying drawings. It should be noted that the following description is merely exemplary in nature, and is not intended to limit the present invention, its application, or its use.

Figure 1:
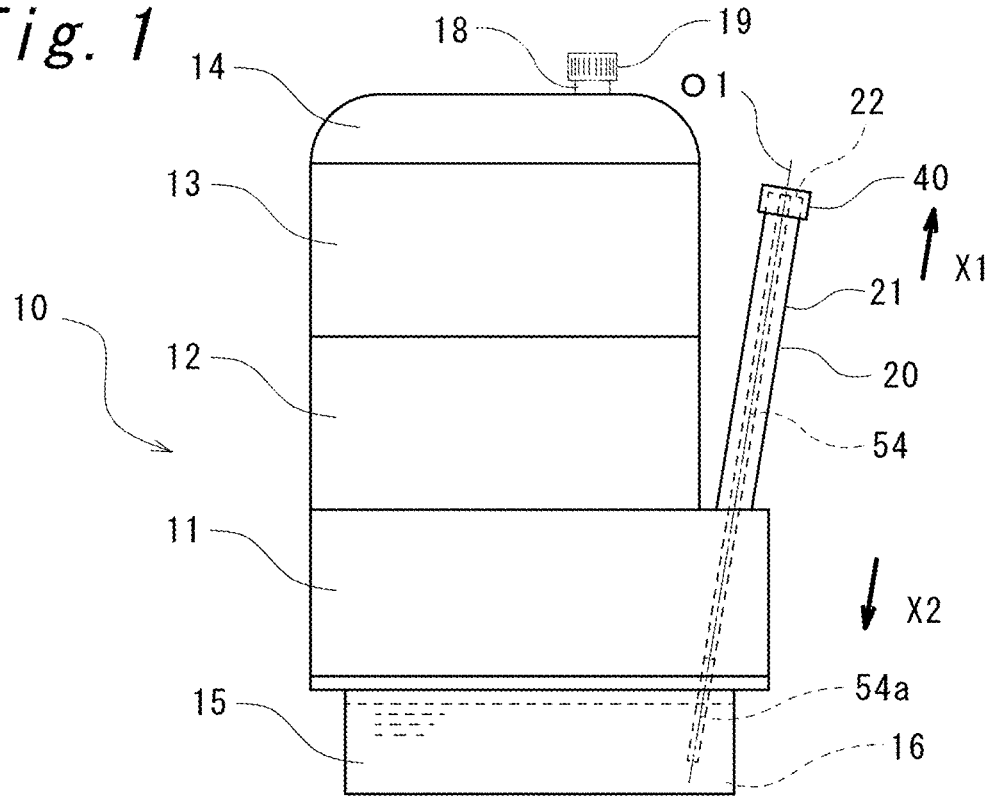
FIG. 1 is a side view of an engine according to an embodiment of the present disclosure.

FIG. 1 is a side view of an engine 10 according to an embodiment of the present disclosure. As shown in FIG. 1, the engine 10 includes a crankcase 11, a cylinder 12, a cylinder head 13, and a head cover 14. An oil pan 15 is attached to a lower surface of the crankcase 11. A fluid reservoir 16 in which engine oil is stored is formed inside the oil pan 15.

In the engine 10, an oil filler pipe 20 which is a tube member is attached to the crankcase 11. In the following description, in the direction along the central axis O1 of the oil filler pipe 20, a direction toward the upper side is referred to as an X1 side, and a direction toward the lower side is referred to as an X2 side. An X1-side end portion of the oil filler pipe 20 is closed by an end cap 40.

A level gauge 54 is housed inside the oil filler pipe 20. In the present embodiment, the level gauge 54 is attached to the end cap 40. The level gauge 54 is provided with a gauge portion 54*a* at the X2-side end portion. The gauge portion 54*a* is positioned in the fluid reservoir 16. The gauge portion 54*a* has a surface roughened so that the engine oil easily adheres thereto, and when the level gauge 54 is pulled out from the oil filler pipe 20, it is possible to check the contamination of the engine oil stored in the fluid reservoir 16 and the height position of the oil level by checking the engine oil adhering to the gauge portion 54*a*.

With the end cap 40 removed from the oil filler pipe 20, the engine oil can be supplied from the mouth end surface 22 of the oil filler pipe 20 to the fluid reservoir 16. Thus, the X1-side opening of the oil filler pipe 20 constitutes an engine-oil filler port.

Figure 2:
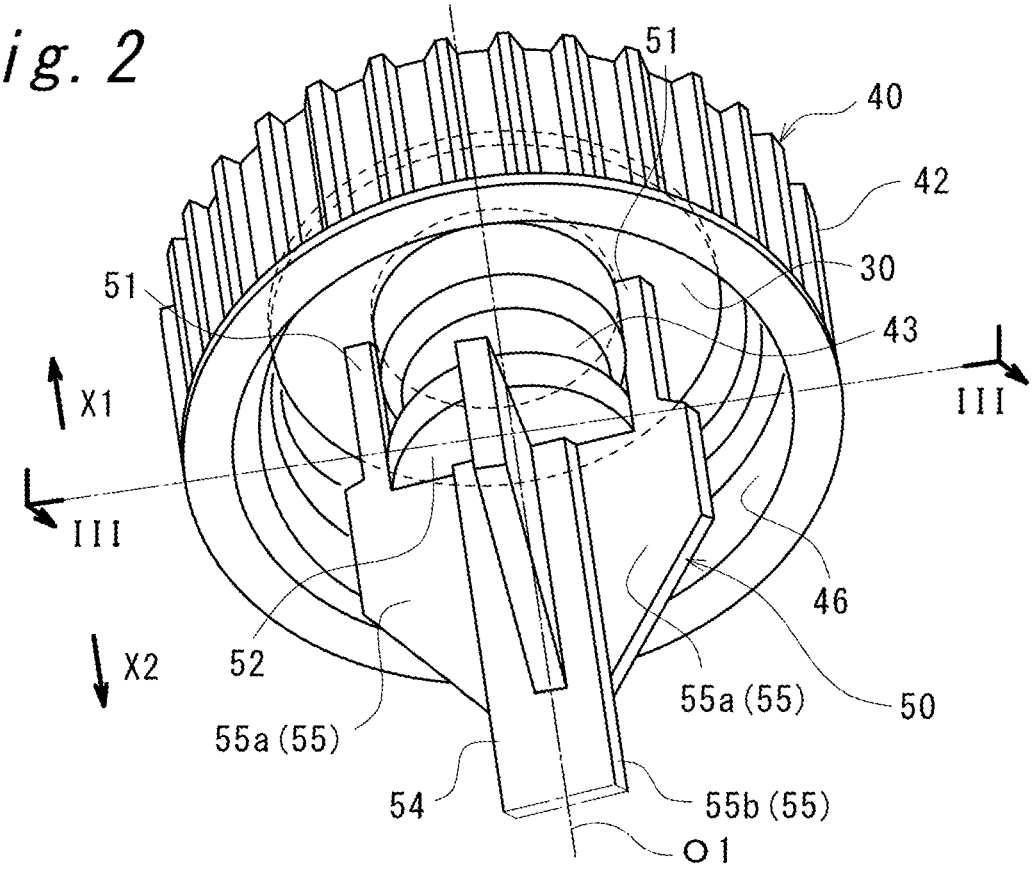
FIG. 2 is a perspective view of an end cap.

FIG. 2 is a perspective view of the end cap 40. As shown in FIG. 2, a gasket 30, a clamping piece 51 that clamps the gasket 30 with the end cap 40, and a level gauge 54 are attached to the end cap 40. The gasket 30 is a plate-shaped rubber member, and extends in an annular shape around the central axis O1. The clamping piece 51 extends along the central axis O1 on both sides across the central axis O1, and clamps the gasket 30 between the clamping piece 51 and the end cap 40 at the tip portion. In the present embodiment, the clamping piece 51 and the level gauge 54 are integrated to form the gasket clamping portion 50.

Figure 3:
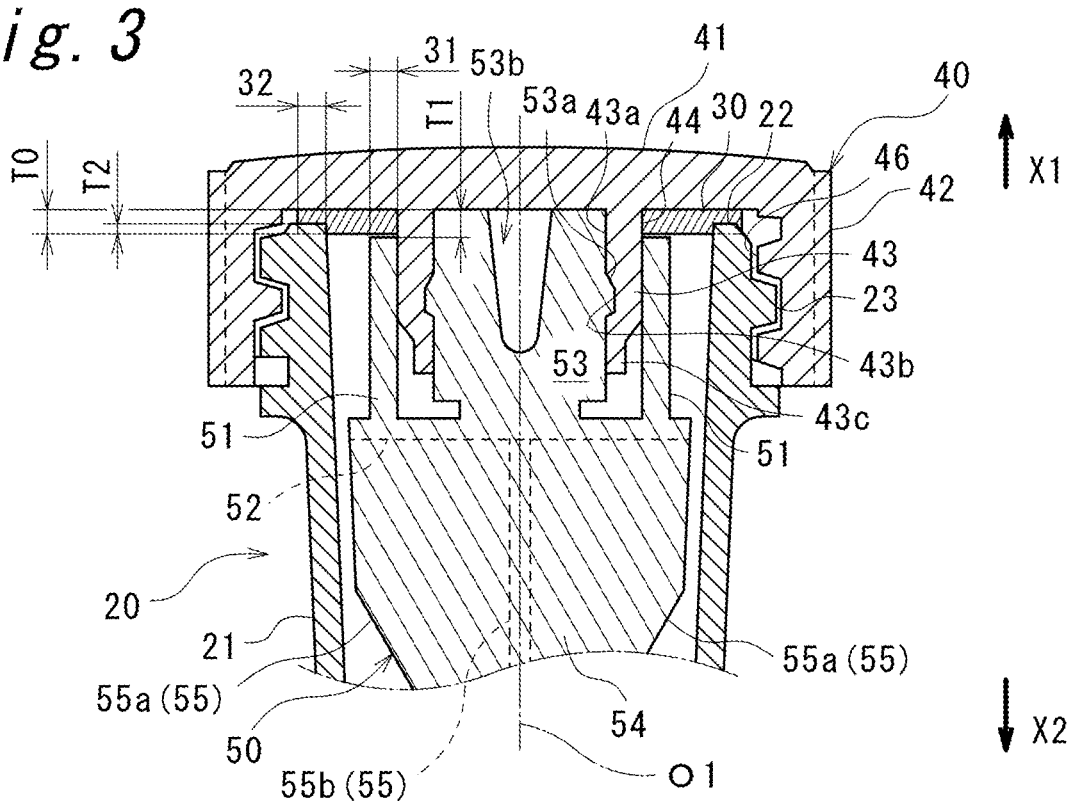
FIG. 3 is a cross-sectional view taken along line III-III in FIG. 2.

FIG. 3 is a cross-sectional view taken along line III-III in FIG. 2 that passes through the central axis O1 and the pair of clamping pieces 51. FIG. 3 also shows an oil filler pipe 20 to which the end cap 40 is attached. As shown in FIG. 3, the oil filler pipe 20 includes a filler tubular wall portion 21 extending in a cylindrical shape along the central axis O1, and a mouth end surface 22 which is an end surface on the X1 side of the filler tubular wall portion 21. On the X1 side in the outer circumferential surface of the filler tubular wall portion 21, a tube member screw portion 23 helically extending around the central axis O1 along the outer circumferential surface is formed.

The end cap 40 includes a cap top wall portion 41, a cap tubular wall portion 42, and a cap cylindrical portion 43. The cap top wall portion 41 spreads in a substantially circular shape in a direction orthogonal to the central axis O1 on the X1 side of the oil filler pipe 20. The cap tubular wall portion 42 extends from the circumferential edge portion of the cap top wall portion 41 toward the X2 side in parallel with the central axis O1 of the oil filler pipe 20 on the outer circumferential side of the filler tubular wall portion 21. The cap tubular wall portion 42 is formed with a cap screw portion 46 helically extending around the central axis O1 along the inner circumferential surface. The end cap 40 is attached to the oil filler pipe 20 by screwing the cap screw portion 46 onto the tube member screw portion 23.

The cap cylindrical portion 43 cylindrically extends from the cap top wall portion 41 toward the X2 side along the central axis O1 on the inner circumferential side of the cap tubular wall portion 42. In a state where the end cap 40 is attached to the oil filler pipe 20, the cap cylindrical portion 43 extends coaxially on the inner circumferential side at a space from the filler tubular wall portion 21.

The outer diameter of the cap cylindrical portion 43 is set to a size to such an extent that the cap cylindrical portion 43 is fitted to the inner circumferential portion of the gasket 30. Accordingly, the position of the gasket 30 is regulated by the cap cylindrical portion 43. That is, the outer surface of the cap cylindrical portion 43 constitutes a gasket regulating portion according to the present disclosure.

The inner circumferential portion 43*a* of the cap cylindrical portion 43 extends in a cylindrical shape along the central axis O1, and is configured so that a clamping piece fitting portion 53 to be described below of the gasket clamping portion 50 is fitted. That is, the inner circumferential portion 43*a* of the cap cylindrical portion 43 constitutes a cap fitting portion according to the present disclosure. In the inner circumferential portion 43*a* of the cap cylindrical portion 43, a recessed portion 43*b* recessed radially outward is formed in the middle in the axial direction. The recessed portion 43*b* annularly extends around the central axis O1. The cap cylindrical portion 43 includes a thin-walled portion 43*c* thinner in wall thickness than the residual portion, at the X2 side end portion.

The gasket clamping portion 50 integrally includes a flange portion 52 connected to the X2 side of a pair of clamping pieces 51 and a clamping piece fitting portion 53 extending from a radial central portion of the flange portion 52 to the X1 side.

The clamping piece 51 extends in the direction along the central axis O1 on the outer circumferential side of the cap cylindrical portion 43 and extends to a position spaced apart on the X2 side from the cap top wall portion 41. The clamping piece 51 is spaced apart radially inward from the filler tubular wall portion 21. The flange portion 52 spreads in a substantially circular shape in a direction orthogonal to the central axis O1. The clamping piece fitting portion 53 is configured to have a size capable of being fitted to the inner circumferential portion 43*a* of the cap cylindrical portion 43.

The clamping piece fitting portion 53 has a fitting piece 53*a* protruding radially outward in the middle in the axial direction. The fitting piece 53*a* is formed to be fittable in the recessed portion 43*b*, and annularly extends around the central axis O1. The clamping piece fitting portion 53 is formed with a hollow portion 53*b* extending from the X1-side end portion to the X2 side. The hollow portion 53*b* extends more toward the X2 side than the fitting piece 53*a*.

When the clamping piece fitting portion 53 is fitted to the cap cylindrical portion 43, the cap cylindrical portion 43 is easily deformed to the outer diameter side at the thin-walled portion 43*c*, whereas the clamping piece fitting portion 53 is easily deformed to the inner diameter side by the hollow portion 53*b*, whereby the clamping piece fitting portion 53 is easily fitted to the cap cylindrical portion 43. In a state where the clamping piece fitting portion 53 is fitted to the cap cylindrical portion 43, the fitting piece 53*a* is fitted to the recessed portion 43*b*. Accordingly, the clamping piece fitting portion 53 is firmly fitted to the cap cylindrical portion 43 and is prevented from coming off.

The gasket clamping portion 50 integrally includes a plate-shaped level gauge 54 extending from the flange portion 52 toward the X2 side. Referring also to FIG. 2, the level gauge 54 includes a reinforcing rib 55 diagonally coupling in a direction along the central axis O1 with the flange portion 52. A plurality of the reinforcing ribs 55 are provided, and each X1-side end portion protrudes radially outward from the flange portion 52.

In the present embodiment, the plurality of reinforcing ribs 55 includes a pair of width direction reinforcing ribs 55*a* connecting both side portions in the width direction of the level gauge 54 and the flange portion 52, and a pair of thickness direction reinforcing ribs 55*b* connecting both end portions in the thickness direction of the level gauge 54 and the flange portion 52. The pair of width direction reinforcing ribs 55*a* is continuous with the X2-side end portions of the pair of clamping pieces 51 at the X1-side end portion.

Here, a first distance T1 in the direction along the central axis O1 between the pair of clamping pieces 51 and the cap top wall portion 41 is larger than the thickness T0 in the same direction of the gasket 30. For example, the first distance T1 may be 1 time or more and 2.5 times or less the thickness T0 of the gasket. On the other hand, in a state where the end cap 40 is attached to the oil filler pipe 20 and the mouth end surface 22 is closed, a second distance T2 in the same direction between the mouth end surface 22 and the cap top wall portion 41 is smaller than the thickness T0 of the gasket 30.

That is, the gasket 30 includes a detachment prevention portion 31 positioned between the pair of clamping pieces 51 and the cap top wall portion 41, and a closing portion 32 positioned between the mouth end surface 22 and the cap top wall portion 41. The detachment prevention portion 31 is spaced apart radially inward from the closing portion 32.

The gasket 30 is compressed in the axial direction by a difference between the thickness T0 of the gasket 30 and the second distance T2 at the closing portion 32, and sealing performance is obtained between the mouth end surface 22 and the cap top wall portion 41. It should be noted that the compression allowance of the gasket 30 can be controlled within an appropriate range by defining a tightening torque when the cap screw portion 46 of the end cap 40 is screwed and attached to the tube member screw portion 23 of the oil filler pipe 20.

On the other hand, at the detachment prevention portion 31, since being smaller than the first distance T1, the thickness T0 of the gasket 30 is not compressed in the axial direction even when the end cap 40 is attached to the oil filler pipe 20, and the influence of the deformation of the detachment prevention portion 31 on the closing portion 32 is prevented.

Figure 4:
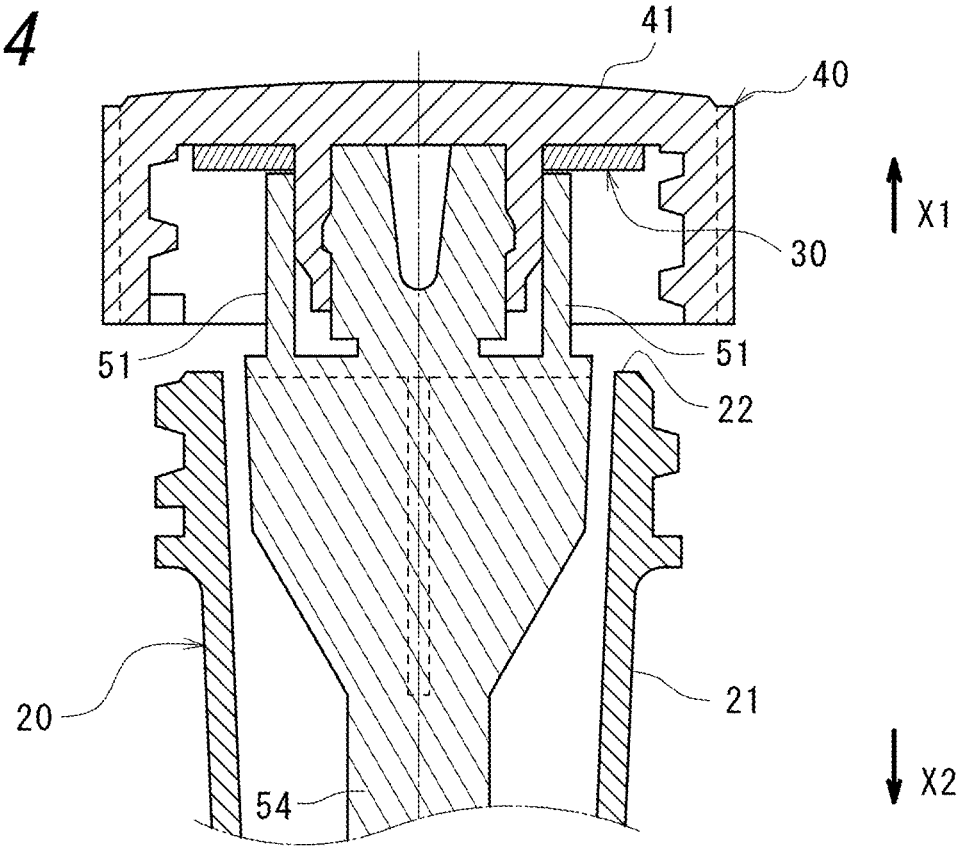
FIG. 4 is a cross-sectional view showing a state in which the end cap is removed from an oil filler.

FIG. 4 shows a state where the end cap 40 is removed from the oil filler pipe 20. As shown in FIG. 4, the gasket 30 is clamped between the pair of clamping pieces 51 and the cap top wall portion 41, and is prevented from falling off the end cap 40. It should be noted that in assembling the gasket 30 to the end cap 40, the gasket clamping portion 50 has only to be fitted to the inner circumferential portion 43*a* of the cap cylindrical portion 43 at the clamping piece fitting portion 53 in a state where the gasket 30 is fitted to the outer circumferential portion of the cap cylindrical portion 43 of the end cap 40 at the inner circumferential portion.

According to the engine 10 according to the present embodiment, following effects can be exhibited.

(1) Provided is a closing structure for an engine 10 including: a fluid reservoir 16 in which a fluid is to be stored; an oil filler pipe 20 extending in a tubular shape, the oil filler pipe 20 having a mouth end surface 22 formed at a tip in an axial direction, the oil filler pipe 20 having an inside communicating with the fluid reservoir 16; a gasket 30 disposed on the mouth end surface 22; an end cap 40 attached to the oil filler pipe 20, the end cap 40 being configured to close the oil filler pipe 20 at the mouth end surface 22 through the gasket 30; and a clamping piece 51 fixed to the end cap 40, the clamping piece 51 being configured to clamp the gasket 30 between the clamping piece 51 and the end cap 40.

As a result, since the gasket 30 is clamped between the end cap 40 and the clamping piece 51 fixed to the end cap 40, the gasket 30 is easily held between the end cap 40 and the clamping piece 51 when the end cap 40 is detached from the oil filler pipe 20, and the gasket 30 is easily prevented from falling off.

(2) In addition, in a state where the end cap 40 closes the oil filler pipe 20, the gasket 30 includes a closing portion 32 to be sandwiched between the mouth end surface 22 of the oil filler pipe 20 and the end cap 40, and a detachment prevention portion 31 positioned to be spaced radially inward from the closing portion 32 and clamped between the clamping piece 51 and the end cap 40.

As a result, since the closing portion 32 and the detachment prevention portion 31 are formed in the gasket 30 at intervals in the radial direction, it is easy to prevent interference between the oil filler pipe 20 and the clamping piece 51.

(3) In addition, a plurality of the clamping pieces 51 are provided.

As a result, since the gasket 30 is clamped between the plurality of clamping pieces 51 and the end cap 40, that is, at a plurality of places, it is easier to prevent the gasket 30 from falling off.

(4) In addition, the plurality of clamping pieces 51 are arranged at equal intervals around the central axis O1 of the oil filler pipe 20. In the present embodiment, a pair of clamping pieces 51 is arranged at intervals of 180 degrees around the central axis O1 of the oil filler pipe 20.

As a result, since the gasket 30 can be clamped in a well-balanced manner around the central axis O1 by the plurality of clamping pieces 51 arranged at equal intervals, the bias of the clamping positions of the gasket 30 by the clamping pieces 51 is prevented, and the gasket 30 is more easily prevented from falling off.

(5) The clamping pieces 51 are provided at least at two places facing each other across the central axis O1.

As a result, since the gasket 30 is clamped at least at two opposing places around the central axis O1, the attitude of the gasket 30 is likely to be properly maintained.

(6) The gasket clamping portion 50 includes a clamping piece fitting portion 53 to be fixed to the end cap 40, and the end cap 40 includes a cap cylindrical portion 43 to which the clamping piece fitting portion 53 is fitted.

As a result, the clamping piece 51 can be easily fixed to the end cap 40 by fitting the clamping piece 51 to the cap cylindrical portion 43 at the clamping piece fitting portion 53.

(7) The end cap 40 includes a gasket regulating portion 44 that regulates movement of the gasket 30 in a direction orthogonal to a central axis O1.

As a result, since the movement in the direction orthogonal to the central axis O1 of the gasket 30 is regulated by the gasket regulating portion 44, it is easy to prevent the positional deviation between the gasket 30 and the end cap 40.

(8) The end cap 40 includes a cap cylindrical portion 43 extending in the axial direction, the gasket 30 is fitted to the outer circumferential portion of the cap cylindrical portion 43, and the clamping piece fitting portion 53 is fitted to the inner circumferential portion 43*a*.

As a result, the fixing of the clamping piece 51 to the end cap 40 and the movement regulation of the gasket 30 can be achieved with one portion, and the complication of the structure can be prevented.

(9) In a state where the end cap 40 closes the oil filler pipe 20, the cap cylindrical portion 43 extends coaxially with the oil filler pipe 20.

As a result, since the gasket 30 is disposed concentrically with the oil filler pipe 20, it is easy to prevent a bias of the clamping position of the gasket 30 with respect to the oil filler pipe 20.

(10) In a state where the end cap 40 closes the oil filler pipe 20, the end cap 40 is further provided with a level gauge 54, inserted into the oil filler pipe 20, for checking a storage amount of the engine oil in the fluid reservoir 16. The level gauge 54 is integrally formed with the clamping piece 51.

As a result, since the level gauge 54 can be configured using the clamping piece 51, an increase in the number of components is suppressed.

(11) The gasket clamping portion 50 includes: a clamping piece fitting portion 53 to be fixed to the end cap 40, and a flange portion 52 positioned between the clamping piece fitting portion 53 and the level gauge 54, the flange portion 52 spreading in a direction orthogonal to the central axis O1. The clamping piece 51 extends in a direction along the central axis O1 from a region facing the gasket 30 in the flange portion 52.

As a result, by fixing the clamping piece 51 to the end cap 40, the level gauge 54 integrally formed with the clamping piece 51 through the flange portion 52 can be fixed to the end cap 40, and thus, the fixing structure of the clamping piece 51 and the fixing structure of the level gauge 54 can be made common, and the structure can be easily simplified.

(12) The level gauge 54 includes a reinforcing rib 55 that extends in a direction along the central axis O1 and protrudes in a radial direction with respect to a residual portion. The clamping piece 51 is formed to be connected to a reinforcing rib 55 in a direction along the central axis O1.

As a result, in the level gauge 54, the rib function, and the clamping function of the gasket 30 can be made common, and the structure can be easily simplified.

(13) The oil filler pipe 20 includes a tube member screw portion 23 helically extending around the central axis O1 along an outer circumferential surface. The end cap 40 includes a cap tubular wall portion 42 extending in a cylindrical shape around the central axis O1, and a cap screw portion 46 helically extending around the central axis O1 on an inner circumferential surface of the cap tubular wall portion 42 and screwed onto the tube member screw portion 23.

As a result, although the force around the central axis O1 is likely to act on the gasket 30 by attaching and detaching the end cap 40 to and from the oil filler pipe 20, the gasket 30 is clamped between the end cap 40 and the clamping piece 51, and thus, the gasket 30 is likely to be prevented from falling off.

(14) The gasket 30 is a plate-shaped rubber material.

As a result, the gasket 30 can be easily configured.

(15) A thickness T0 in a direction along the central axis O1 of the gasket 30 is shorter than a first distance T1 in a direction along the central axis O1 between the end cap 40 and the clamping piece 51.

As a result, since the compressive deformation in the axial direction at the detachment prevention portion 31 of the gasket 30 is suppressed, the effect of preventing the gasket 30 from falling off the end cap 40 is easily sustained.

(16) In a state where the end cap 40 closes the oil filler pipe 20, the gasket 30 includes a closing portion 32 clamped between the mouth end surface 22 and the end cap 40 and compressed in a direction along the central axis O1, and a second distance T2 in a direction along the central axis O1 between the mouth end surface 22 of the oil filler pipe 20 and the end cap 40 is shorter than the first distance T1 between the end cap 40 and the clamping piece 51. That is, the second distance T2 is smaller than the thickness T0 of the gasket. In particular, the first distance T1 is preferably larger than the thickness T0 of the gasket.

As a result, since the deformation of the gasket 30 caused by the clamping by the clamping piece 51 and the end cap 40 is suppressed, the influence on the gasket 30 positioned between the end cap 40 and the mouth end surface 22 is suppressed, and as a result, the sealing performance by the gasket 30 can be suitably exhibited.

Figure 5:
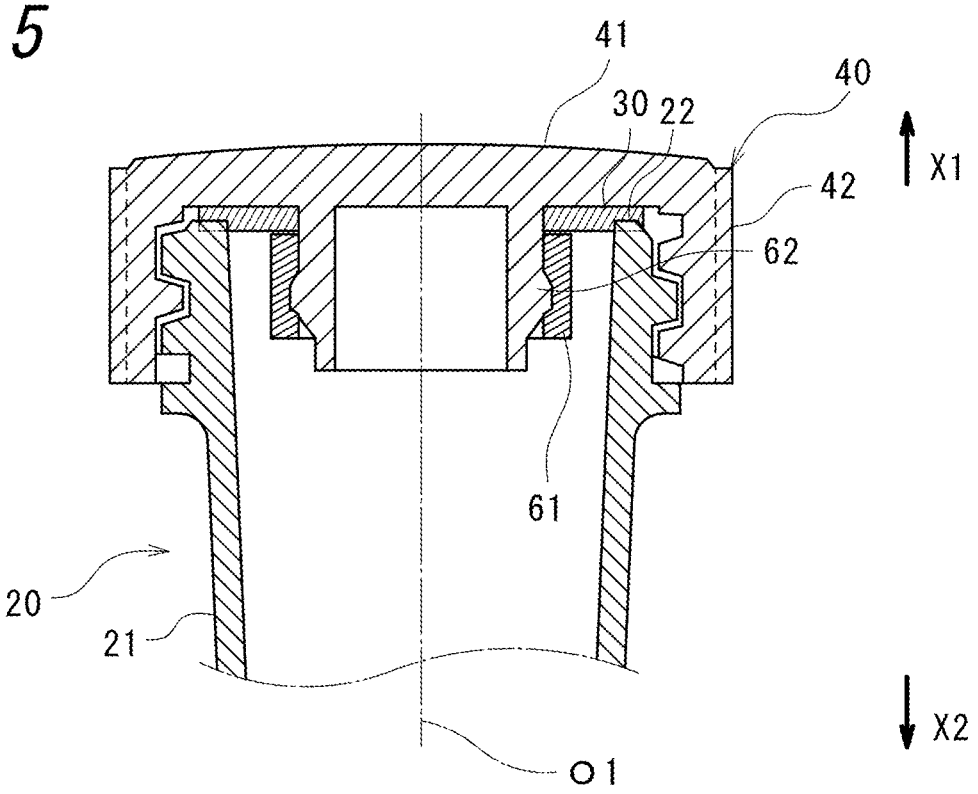
FIG. 5 is a cross-sectional view showing an end cap according to a first modification.

In the above embodiment, the case where the level gauge 54 is integrally formed as the gasket clamping portion 50 has been described as an example, but the present disclosure is not limited thereto. For example, as in a first modification shown in FIG. 5, a ring-shaped gasket clamping piece 61 fitted to the outer circumferential portion of the cap cylindrical portion 62 may be provided instead of the gasket clamping portion 50. In this case, the gasket 30 is held between the gasket clamping piece 61 and the cap top wall portion 41.

Figure 6:
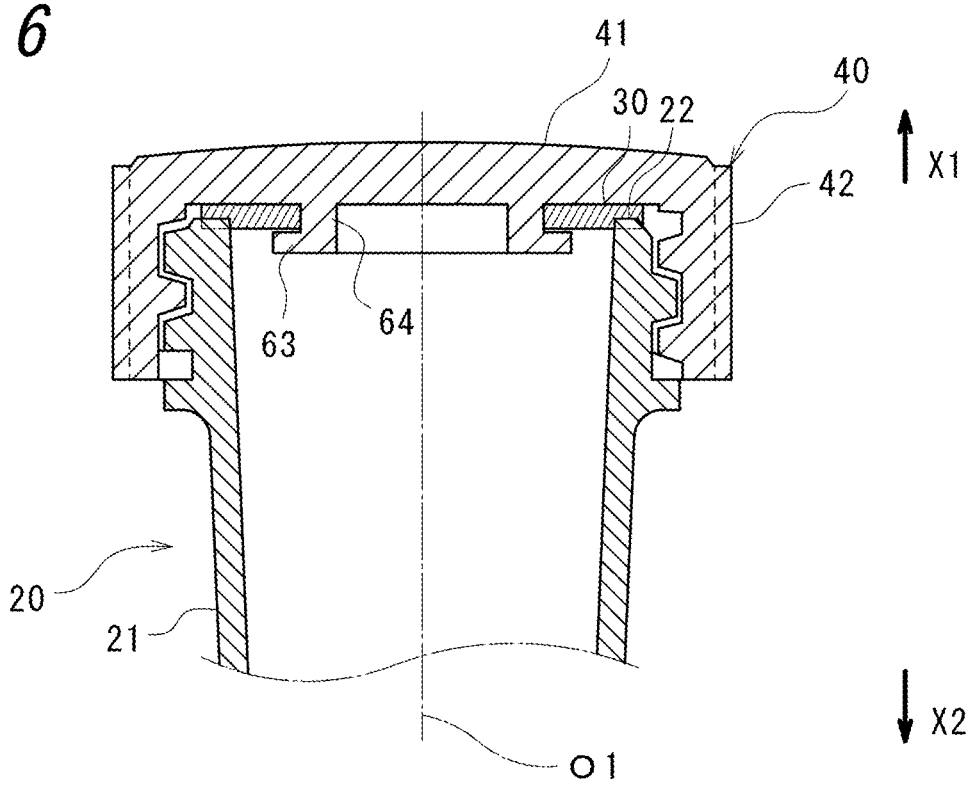
FIG. 6 is a cross-sectional view showing an end cap according to a second modification.

In addition, as in a second modification shown in FIG. 6, instead of the gasket clamping portion 50, the clamping piece 63 may be integrally formed so that the entire circumference or at least a part of the cap cylindrical portion 64 corresponding to the cap cylindrical portion 43 protrudes radially outward. In this case, since the clamping piece 63 is integrally formed with the end cap 40, it is not necessary to form the clamping piece 63 as a separate body, and the structure can be easily simplified.

Figure 7:
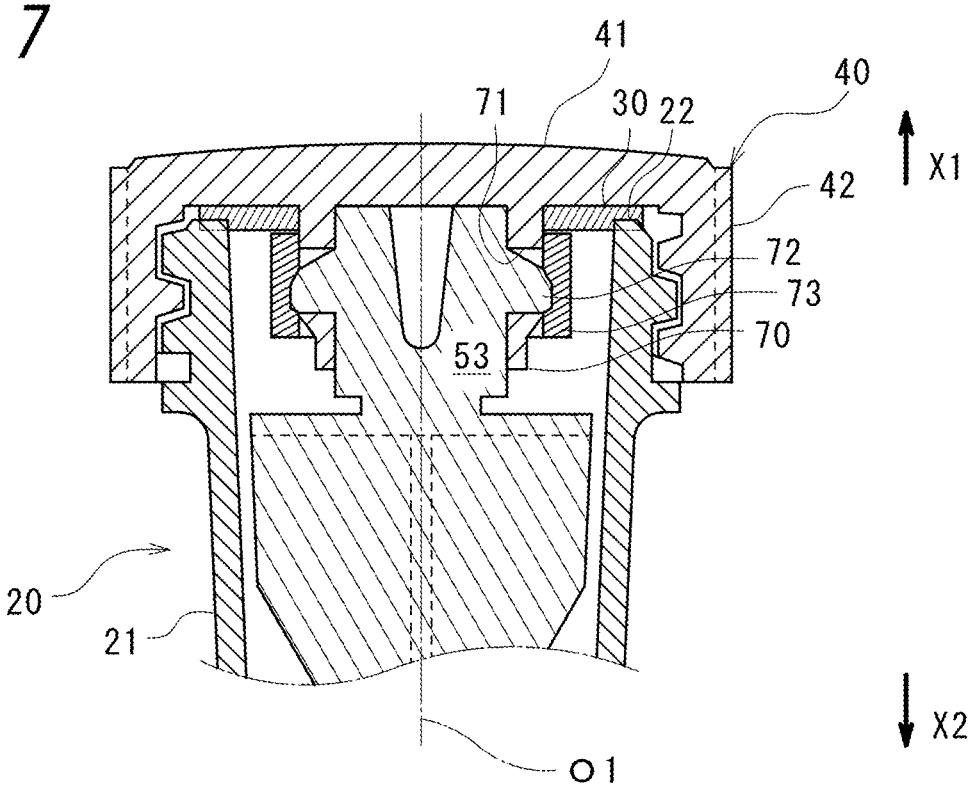
FIG. 7 is a cross-sectional view showing an end cap according to a third modification.

In addition, as in a third modification shown in FIG. 7, a hole portion 71 penetrating in the radial direction may be formed in the middle in the axial direction O1 of the cap cylindrical portion 70, a protruding portion 72 that is fitted to the hole portion 71 and protrudes radially outward from the clamping piece fitting portion 53 may be provided in the clamping piece fitting portion 53, a ring-shaped gasket clamping piece 73 that is fitted to the outer circumferential portion of the cap cylindrical portion 70 may be provided, and the tip portion of the protruding portion 72 may be fitted to the inner circumferential portion of the gasket clamping piece 73. In this case, the clamping piece fitting portion 53 and the gasket clamping piece 73 can be fixed to the cap cylindrical portion 70 using the common protruding portion 72, and the gasket 30 can be held between the gasket clamping piece 73 and the cap top wall portion 41 of the end cap 40.

Figure 8:
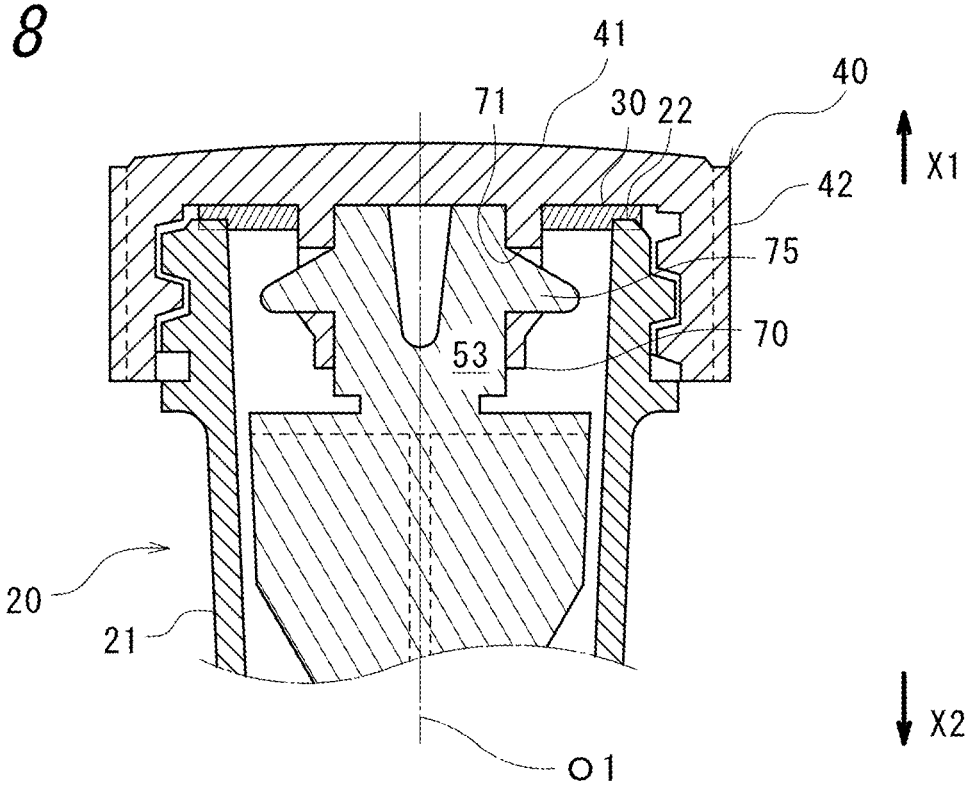
FIG. 8 is a cross-sectional view showing an end cap according to a fourth modification.

In addition, as in a fourth modification shown in FIG. 8, with the third modification as a base, instead of the protruding portion 72, a protruding portion 75 further protruding radially outward than the protruding portion 72 may be provided, and the gasket clamping piece 73 may be removed. Specifically, the protruding portion 75 radially extends to a position facing the inner diameter portion of the gasket 30 (corresponding to the detachment prevention portion 31 shown in FIG. 3) in the axial direction O1. As a result, since the gasket 30 is positioned between the protruding portion 75, and the cap top wall portion 41 of the end cap 40, it is not necessary to provide the gasket clamping piece 73, and the gasket 30 is prevented from falling off the end cap 40 by the protruding portion 75.

Figure 9:
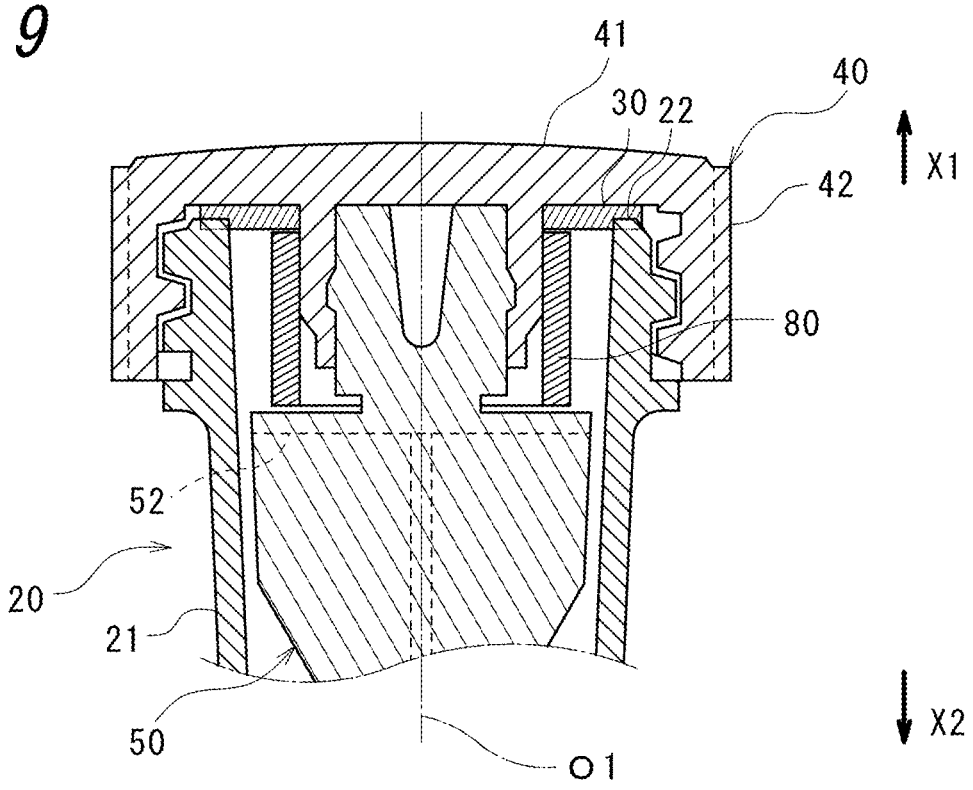
FIG. 9 is a cross-sectional view showing an end cap according to a fifth modification.

In addition, as in a fifth modification shown in FIG. 9, instead of the clamping piece 51 of the gasket clamping portion 50, a ring-shaped gasket clamping piece 80 that is configured separately from the gasket clamping portion 50 and extends between the flange portion 52 and the end cap 40 may be disposed. In this case, since it is not necessary to integrally form the gasket clamping piece in the gasket clamping portion 50, the structure can be simplified, and the gasket 30 can be held between the gasket clamping piece 80, and the cap top wall portion 41 of the end cap 40.

In addition, in the above embodiment, the oil filler pipe 20 has been described as an example of the tube member, but the present disclosure is not limited thereto. For example, as indicated by a two-dot chain line in FIG. 1, the closing structure for a tube member according to the present disclosure may be applied to the end cap 19 attached to the oil filler port 18 provided in the head cover 14.

In addition, in the above embodiment, the engine oil has been described as an example of the fluid stored in the fluid reservoir 16, but the present disclosure is not limited thereto. In the case of closing a mouth provided with a tube member communicating with a fluid reservoir in which any fluid such as cooling water or brake oil is stored, the closing structure for a tube member according to the present disclosure may be applied.

In addition, in the above embodiment, a case of controlling the compression allowance of the gasket 30 within an appropriate range by defining a tightening torque when the cap screw portion 46 of the end cap 40 is screwed and attached to the tube member screw portion 23 of the oil filler pipe 20 has been described as an example, but the present disclosure is not limited thereto. For example, one of the cap screw portion 46 and the tube member screw portion 23 may be provided with a protruding portion, the other may be provided with a recessed portion to be fitted to the protruding portion, and the end cap 40 may be rotated by a predetermined rotation amount (for example, ¼ rotation) with respect to the oil filler pipe 20 to fit the protruding portion to the recessed portion, thereby generating a constant compression allowance with respect to the gasket 30 without performing torque control.

Various modifications can be made without departing from the scope of the present disclosure.

What is claimed is:

1. A closing structure comprising:

a fluid reservoir for storing a fluid;

a tube member having a mouth end surface at a tip in an axial direction of the tube member, the tube member having an inside communicating with the fluid reservoir;

a gasket configured to be disposed on the mouth end surface of the tube member in the axial direction of the tube member;

an end cap configured to: (i) be attached to the tube member; and (ii) close the tube member at the mouth end surface of the tube member through the gasket; and a clamping piece fixed to the end cap, wherein:

the gasket is clamped in an axial direction of the end cap by the end cap and the clamping piece;

the gasket includes: (i) a closing portion configured to be sandwiched between the mouth end surface of the tube member and the end cap in a state where the end cap closes the tube member; and (ii) a detachment prevention portion configured to be clamped between the clamping piece and the end cap in the state where the end cap closes the tube member; and the closing portion and the detachment prevention portion do not overlap with each other when viewed from the axial direction of the end cap.

2. The closing structure according to claim 1, wherein the detachment prevention portion is spaced radially inward from the closing portion.

3. The closing structure according to claim 1, wherein the closing structure comprises at least two of the clamping pieces.

4. The closing structure according to claim 3, wherein the at least two of the clamping pieces are arranged at equal intervals around an axis of the end cap.

5. The closing structure according to claim 4, wherein the at least two of the clamping pieces are positioned at least at two positions facing each other across the axis of the end cap.

6. The closing structure according to claim 1, wherein:

the clamping piece includes a clamping piece fitting portion configured to be fixed to the end cap; and the end cap includes a cap fitting portion to which the clamping piece fitting portion is configured to be fitted.

7. The closing structure according to claim 1, wherein the end cap includes a gasket regulating portion configured to regulate movement of the gasket in a direction orthogonal to a central axis of the end cap.

8. The closing structure according to claim 1, wherein:

the end cap includes a cap cylindrical portion extending in the axial direction of the end cap; and both the gasket and the clamping piece are fitted to the cap cylindrical portion.

9. The closing structure according to claim 1, further comprising:

a level gauge, configured to be inserted into the tube member in the state where the end cap closes the tube member, for checking a storage amount of the fluid in the fluid reservoir; and the level gauge is integrally formed with the clamping piece.

10. The closing structure according to claim 9, wherein:

the clamping piece includes:

a clamping piece fitting portion configured to be fixed to the end cap, and a flange portion positioned between the clamping piece fitting portion and the level gauge, the flange portion extending in a direction orthogonal to the axial direction of the end cap, and the clamping piece extends in the axial direction of the end cap from a region facing the gasket in the flange portion.

11. The closing structure according to claim 9, wherein:

the level gauge includes a reinforcing rib that extends in the axial direction of the end cap and protrudes in a radial direction with respect to a residual portion; and the clamping piece is configured to be connected to the reinforcing rib in the axial direction of the end cap.

12. The closing structure according to claim 1, wherein:

the tube member includes a tube member screw portion helically extending around an axis of the tube member along an outer circumferential surface; and the end cap includes a cap tubular wall portion extending in a cylindrical shape around an axis of the end cap, and a cap screw portion helically extending around the axis of the end cap on an inner circumferential surface of the cap tubular wall portion and being configured to be screwed onto the tube member screw portion.

13. The closing structure according to claim 1, wherein a thickness of the gasket in the axial direction of the end cap is less than a distance between the end cap and the clamping piece in the axial direction of the end cap.

14. The closing structure according to claim 1, wherein:

the closing portion is configured to be compressed in the axial direction of the tube member in the state where the end cap closes the tube member; and in the state where the end cap closes the tube member, a first distance between the mouth end surface of the tube member and the end cap in the axial direction of the tube member is less than a second distance between the end cap and the clamping piece in the axial direction of the tube member.

15. An engine comprising the closing structure according to claim 1.

16. The engine according to claim 15, wherein the fluid is an engine oil.

17. The closing structure according to claim 1, wherein a distance between the end cap and the clamping piece in the axial direction of the end cap is greater than a thickness of the gasket in the axial direction of the end cap.

18. The closing structure according to claim 17, wherein the distance between the end cap and the clamping piece in the axial direction of the end cap is:

equal to or greater than one time the thickness of the gasket in the axial direction of the end cap; and equal to or less than 2.5 times the thickness of the gasket in the axial direction of the end cap.

* * * * *